United States Patent [19]

Leland

[11] Patent Number: 4,519,605

[45] Date of Patent: May 28, 1985

[54] COMBINATION EXERCISE AND MASSAGE APPARATUS

[76] Inventor: Ragnvald G. Leland, P.O. Box 4174, Palm Springs, Calif. 92263

[21] Appl. No.: 435,329

[22] Filed: Oct. 19, 1982

[51] Int. Cl.[3] ..... A63B 21/00

[52] U.S. Cl. ..... 272/116; 272/134; 272/136; 272/142; 128/57

[58] Field of Search ..... 272/136, 142, 93, 135, 272/134, 118, 127; 128/24.3, 25 R, 57

[56] References Cited

U.S. PATENT DOCUMENTS

| | | | |
|---|---|---|---|
| 781,683 | 2/1905 | Shepherd . | |
| 1,075,309 | 10/1913 | Sullivan | 272/136 |
| 1,114,458 | 10/1914 | Friedi | 272/118 |
| 1,561,979 | 11/1925 | Gore | 272/134 |
| 1,582,487 | 4/1926 | Shank | 272/134 |
| 2,267,376 | 12/1941 | Malm . | |
| 2,682,402 | 6/1954 | McCarthy . | |
| 2,928,675 | 3/1960 | Nawara . | |
| 3,455,295 | 7/1969 | Kellogg | 125/25 R |
| 3,501,140 | 3/1970 | Eichorn . | |
| 3,707,284 | 12/1972 | Waldeck . | |
| 3,945,637 | 3/1976 | Simjian . | |
| 4,142,519 | 3/1979 | Ferguson | 128/57 |
| 4,193,394 | 3/1980 | Everett et al. | 272/134 X |
| 4,411,421 | 10/1983 | Hershberger | 128/57 X |

*Primary Examiner*—Richard J. Apley
*Assistant Examiner*—William R. Browne
*Attorney, Agent, or Firm*—Berman, Aisenberg & Platt

[57] ABSTRACT

Compact combination exercise and massage apparatus which includes a modular support frame including front, intermediate and rear sections built of materials such as plastic tubing so as to be lightweight and modular in construction. A platform is suspended on the support frame and a resilient body support rests on the platform for promoting reciprocating movement of the user during exercise. A first pair of resilient hand grips is suspended from the intermediate section of the support frame for providing exercise in either a standing or sitting position. A second pair of resilient hand grips is suspended from the rear section of the frame for providing exercise in a sitting position. A massage device is suspended from the rear section of the frame for use in the standing position, and a gate is removably attached to the front section of the frame for use in combination with the massage device in a sitting position.

10 Claims, 6 Drawing Figures

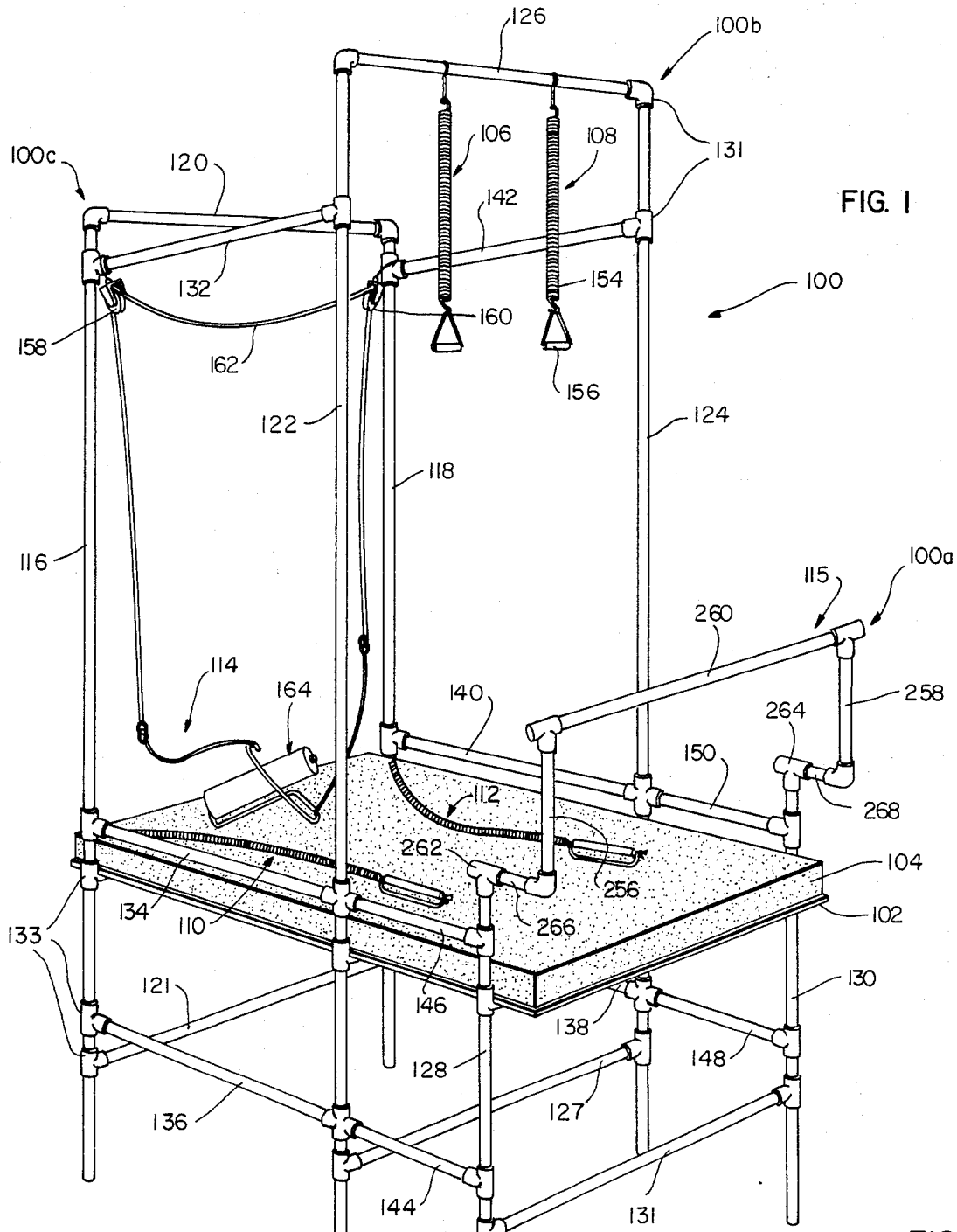
FIG. 1
FIG. 4
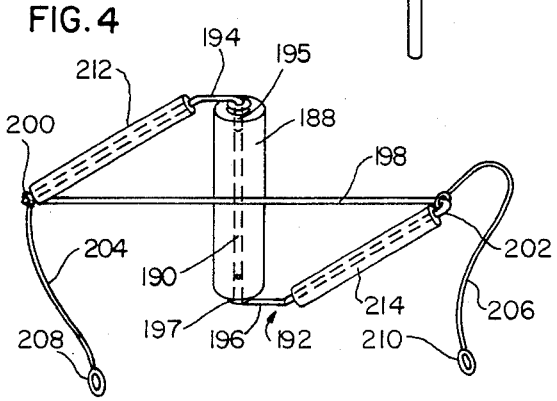
FIG. 5
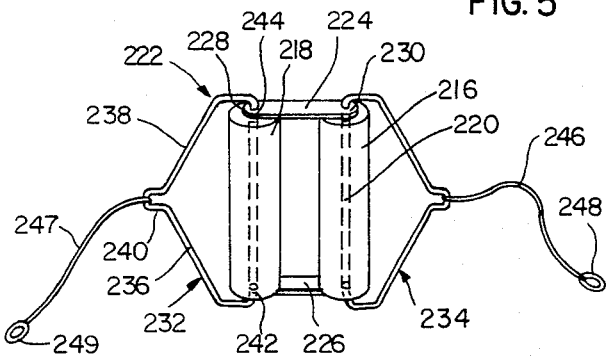

COMBINATION EXERCISE AND MASSAGE APPARATUS

BACKGROUND OF THE INVENTION

1. Field of the Invention

This invention relates to combination exercise and massage apparatus, and more particularly to such apparatus which supports the user and facilitates reciprocating motion during exercise, is designed to be taken apart and put together easily, and is light in weight.

2. Description of Related Art

Various apparatus have been proposed in the past combining different kinds of exercise devices or exercise and massage devices. Such apparatus are exemplified by the following U.S. Pat. Nos. 781,683; 1,582,487; 2,682,402; 3,707,284; and 3,945,637.

While the apparatus described in the above-cited patents are useful in providing exercise and massage, when used in the home by the average person, each of the patented devices suffers from one or more deficiencies.

For example, the apparatus described in U.S. Pat. No. 1,582,487 comprises a bed disposed in a large tubular frame. Various kinds of exercise devices are incorporated in or are suspended from the tubular frame. Because of its size and its manner of construction, this device cannot easily be moved to suit the convenience of the user, or stored when it is not in use. Moreover, the exercise devices are not so placed with relation to the bed that the mattress is made an integral part of the exercise provided by the exercise devices.

The device described in U.S. Pat. No. 3,707,284 is relatively compact, and apparently can be taken apart and folded for storage, but the support platform on which the user rests does not enhance the value of the exercise provided by the exercise devices. Although rollers are provided for massaging the back of the head, neck or shoulders, the rollers are stationary and the user must be extremely agile to obtain any benefit therefrom. Moreover, because the support platform lies close to the floor, it cannot easily be used by a person with back problems, or a handicapped user.

The apparatus described in U.S. Pat. No. 3,501,140 is collapsible, but in use it takes up a great deal of floor space and the exercise attachments are heavy in weight.

The apparatus described in U.S. Pat. No. 2,682,402 comprises another kind of tubular frame from which exercise devices are suspended. Again, this apparatus can be collapsed for moving and storage, but takes up a great deal of floor space in use. Neither of the two previously described devices provide massage means or a resilient body support which enhances the value of the exercise provided by the exercise attachments.

Other apparatus such as that described in U.S. Pat. Nos. 781,683 and 3,945,637, while providing both massage and exercise, only provide exercise for one part of the body.

In the design of home exercise and massage apparatus, it is extremely important that the apparatus be easily moved to suit the convenience of the user, and capable of storage when not in use. Therefore, an important feature of home exercise and massage apparatus would be simplicity, compactness, and lightweight.

The home user desires apparatus that provides a complete range of exercise and massage but is safe to use in the absence of expert supervision. Therefore, another important design feature would be exercise and massage devices that are very versatile and yet simple to use.

An often overlooked segment of society for which home exercise is very important is the handicapped. Therefore, another important feature of home exercise and massage apparatus is that it offer exercise and massage attachments that can be adapted for use by the handicapped.

The present invention is advanced with a view toward meeting the above-noted requirements for a practical combination exercise and massage apparatus for home use, while overcoming the deficiencies of the prior art devices described above.

OBJECTS OF THE INVENTION

It is therefore a primary object of the present invention to provide combination exercise and massage appartus which overcomes the deficiencies noted above with respect to prior art devices.

Another object of the present invention is to provide combination exercise and massage apparatus which can be easily taken apart and put together, and stored when not in use.

Yet another object of the present invention is to provide combination exercise and massage apparatus which is compact and lightweight.

Another object of the present invention is to provide combination exercise and massage apparatus in which reciprocating motion of the user is facilitated during exercise.

A still further object of the present invention is to provide exercise and massage apparatus which is capable of use by the handicapped.

SUMMARY OF THE INVENTION

The foregoing and other objects are attained in accordance with one aspect of the present invention through the provision of compact combination exercise and massage apparatus which comprises a modular support frame including front, intermediate and rear sections built of materials such as plastic tubing so as to be lightweight and modular in construction, a platform suspended on the support frame, resilient body support means resting on the platform for promoting reciprocating movement of the user during exercise, a first pair of resilient hand grip means suspended from the intermediate section of the support frame for providing exercise in either a standing or sitting position, a second pair of resilient hand grip means suspended from the rear section of the frame for providing exercise in a sitting position, and massage means suspended from the rear section of the frame for use in the standing position. The apparatus may also include gate means removably attached to the front section of the frame for use in combination with massage means in a sitting position.

In accordance with more specific aspects of the present invention, the rear section of the support frame includes first and second rear vertical spaced apart members joined across their tops by a rear crossbar and forming a first plane. The intermediate section of the support frame includes first and second intermediate vertical spaced apart members joined across their tops by an intermediate crossbar, and forming a second plane parallel to the first plane. The front section of the support frame includes first and second front vertical spaced apart members forming a third plane parallel to the first and second planes. The tops of the first and second front vertical spaced apart members are substantially level with the top of the resilient body support means. Horizontal support members join the rear vertical spaced apart members to the intermediate vertical spaced apart members, and the intermediate vertical spaced apart members to the front vertical spaced apart members for stability.

In accordance with yet more specific aspects of the present invention, the resilient hand grip means include a hand grip attached to one end of a coil spring, and the first pair of hand grip means is suspended from the intermediate crossbar.

In accordance with yet more specific aspects of the present invention, the massage means includes first and second pulleys attached respectively to the first and second rear vertical spaced apart members, rope passing through the first and second pulleys, and roller means removably attached to the ends of the rope.

In accordance with other aspects of the present invention, the roller means may comprise single or double cylindrical rollers, a substantially rigid frame supporting the rollers so as to permit their rotation, and ropes with handles attached to the frame so that the roller means may be used independently of the apparatus or in combination therewith.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 1 is a perspective view of a preferred embodiment of the present invention when not in use;

FIG. 4 is an illustration of another preferred embodiment of the roller means used in the present apparatus;

FIG. 5 is an illustration of still another preferred embodiment of the roller means used in the present apparatus;

DETAILED DESCRIPTION OF THE PREFERRED EMBODIMENTS

Figure 2:
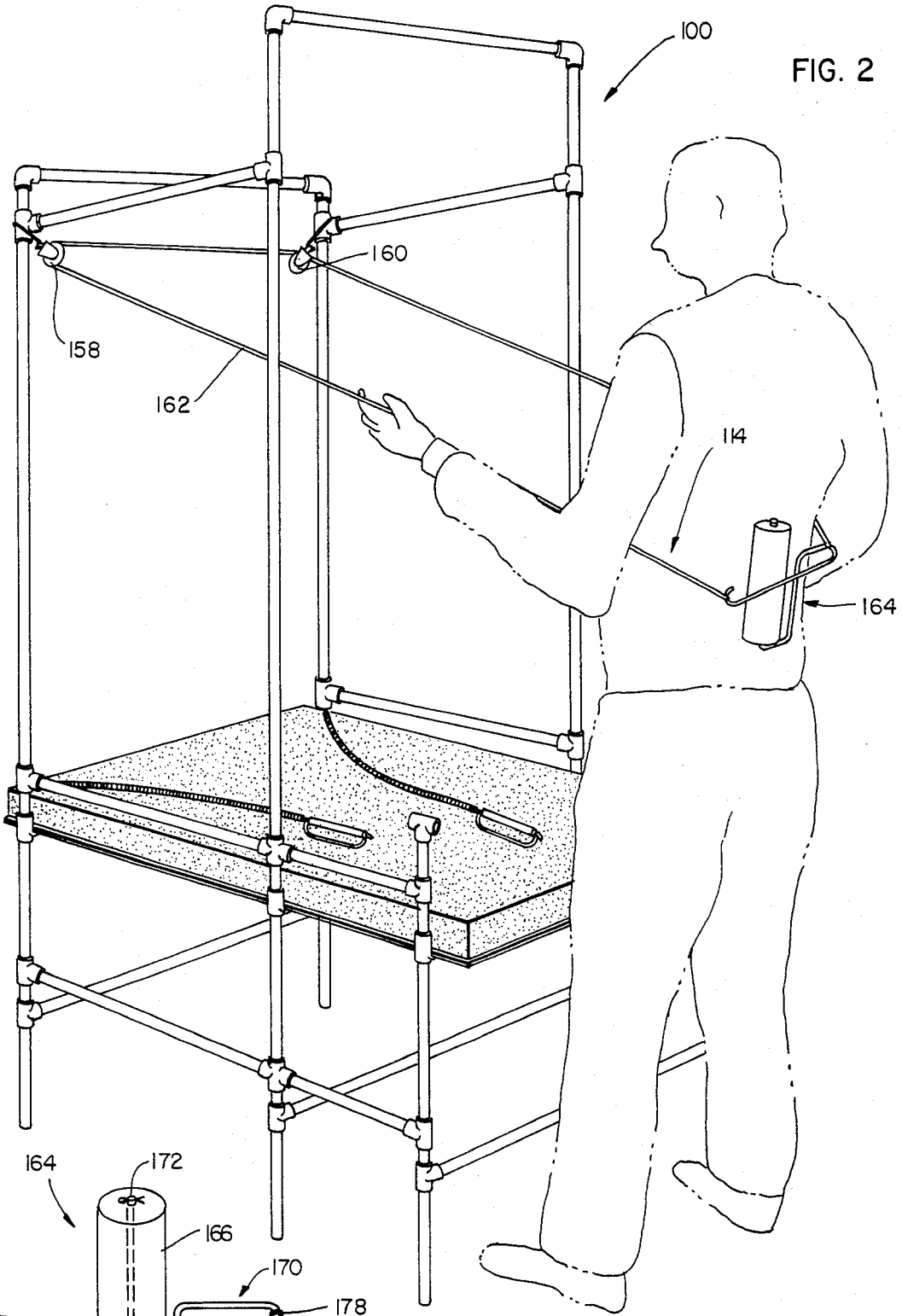
FIG. 2 is a perspective view which illustrates the preferred embodiment during use.

Referring now to the drawings, wherein like reference numerals represent identical or corresponding parts throughout several views, and more particularly to FIG. 1 thereof, a preferred embodiment of the combination exercise and massage apparatus of the present invention is illustrated.

The apparatus consists of a modular tubular support frame 100 having front, intermediate and rear sections 100*a*, 100*b*, and 100*c*. Support frame 100 may be constructed of tubes made of a durable, lightweight material, such as plastic.

A platform 102 is suspended horizontally on support frame 100. Platform 102 is generally rectangular, conforming to the lateral dimensions of the support frame 100, and may be made of any durable, substantially rigid material, such as plywood.

In the preferred form, the rear section 100*c* of support frame 100 includes first and second rear vertical spaced apart members 116, 118, joined across their tops by rear top crossbar 120, forming a first plane. The intermediate section 100*b* of support frame 100 includes first and second intermediate vertical spaced apart members 122, 124 joined across their tops by intermediate top crossbar 126, and forming a second plane parallel to the first plane. The front section 100*a* of support frame 100 includes first and second front vertical spaced apart members 128, 130 forming a third plane parallel to the first and second planes. The tops of front vertical spaced apart members 128, 130, are substantially level with the top of resilient body support means 104. A plurality of horizontal support members 132–142 join rear vertical spaced apart members 116, 118 to intermediate vertical spaced apart members 122, 124 to provide rigidity and stability to the apparatus. A plurality of horizontal support members 144–150 join intermediate vertical spaced apart members 122, 124 to front vertical spaced apart members 128, 130, also to provide rigidity and stability.

In the preferred form, rear vertical spaced apart members 116, 118 are connected with the bottom by rear lower crossbar 121, intermediate vertical spaced apart members 122, 124 are connected towards the bottom by intermediate bottom crossbar member 127, and front vertical spaced apart members 128, 130 are connected towards the bottom by bottom crossbar 131 to provide rigidity and stability of the apparatus. It is understood that any number of crossbars and horizontal support members such as horizontal support members 132–150 may similarly be used to provide rigidity and support.

In order that support frame 100 may be as compact as possible when taken apart, each member 116, 118, 122, 124, 128, and 130 is preferably formed by several lengths of tubing joined by connectors 133. Connectors 133 may also be used to connect crossbars 120, 121, 126, 127 and 131, as well as horizontal support members 132–142 and 144–150 respectively thereto.

Figure 6:
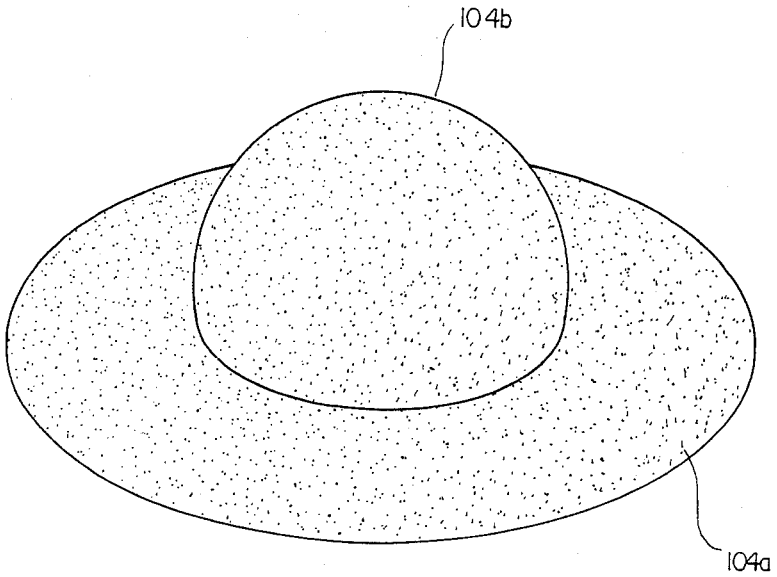
FIG. 6 is an illustration of an embodiment of the resilient body support means used in the present apparatus.

Resilient body support means 104 rests on platform 102. Body support means 104 may be an inner spring, air or foam mattress, or any other means which promotes reciprocating motion of the user upon coming into contact therewith. If an air mattress is used, it may be deflated for more compact storage. In an alternate embodiment, a two-piece inflatable cushion as seen in FIG. 6 is used. The first piece comprises an inflatable ring or torus 104*a* having a center hole. The second piece is an inflatable sphere 104*b* positioned in matching engagement with the center hole of the first piece. When partially inflated, this configuration imparts a beneficial rolling motion to the user.

A first pair of resilient hand grip means 106, 108 is suspended from the intermediate section 100*b* of support frame 100, and a second pair of resilient hand grip means 110, 112 is suspended from the rear section 100*c* of support frame 100. In a preferred embodiment, each of resilient hand grip means 106, 108, 110, 112 comprises a hand grip 156 attached to one end of a coil spring 154, the other end of the coil spring being suspended from support frame 100, and first pair 106, 108 is slidably suspended from intermediate top crossbar 126. The suspension means may comprise chain link or any other conventional means.

Suspended from the rear section 100*c* of support frame 100 is massage means 114. Generally, the massage means 114 includes first and second pulleys 158, 160 attached respectively to rear vertical spaced apart members 116, 118, a rope 162 passing through pulleys 158, 160, and roller means 164 removably attached to the ends of rope 162. Roller means 164 may thus be used independently of or in combination with the exercise and massage apparatus of the present invention.

Figure 3:
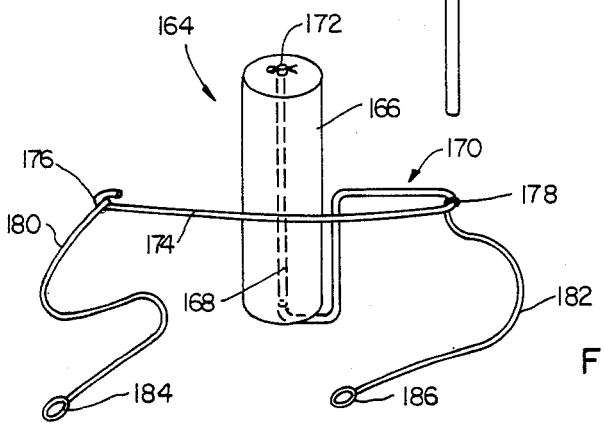
FIG. 3 is an illustration of a preferred embodiment of the roller means used in the present apparatus.

In one preferred embodiment illustrated in FIG. 3, roller means 164 includes a single cylindrical roller 166 having an aperture 168 therethrough. Frame 170 rotatably supports roller 166. Frame 170 is substantially rigid and comprises a leg 172 passing through aperture 168 for rotatably securing roller 166 to frame 170, and arcuate bridge 174 connected to leg 172 passing around the midsection of roller 166. The ends 176, 178 of bridge 174 comprise rope securing means. Ropes 180, 182 are secured respectively to ends 176, 178 and handles 184, 186 are secured respectively to ropes 180, 182. Handles 184, 186 are adapted to receive the ends of rope 162, which may then be secured to handles 184, 186 by any conventional means.

In another preferred embodiment illustrated in FIG. 4, roller means 164 includes a single cylindrical roller 188 having an aperture 190 therethrough. Substantially rigid frame 192 rotatably supports roller 188. Frame 192 is substantially Z-shaped, having upper and lower legs 194, 196 diagonally connected by cross-piece 198 at upper and lower elbows 200, 202. The ends of legs 194, 196 form roller securing means 195, 197 for rotatably securing roller 164 to frame 190. Ropes 204, 206 are secured to upper and lower elbows 200, 202 and handles 208, 210 are secured respectively to the free end of ropes 204, 206. Tubes 212, 214 may be placed respectively over upper and lower legs 194, 196 to prevent ropes 204, 206 from sliding out of position at upper and lower elbows 200, 202. Handles 208, 210 are adapted to receive the ends of rope 162, which may then be secured to handles 208 by any conventional means.

In yet another preferred embodiment illustrated in FIG. 5, roller means 164 comprises a pair of parallel, spaced apart cylindrical rollers 216, 218, each roller having an aperture 220 therethrough. A frame 222 rotatably supports rollers 216, 218. Frame 222 is substantially rigid and includes a pair of spacer plates 224, 226 and a pair of bridges 232, 234. Spacer plates 224, 226 are positioned one at each pair of ends of rollers 216, 218 for holding the rollers at a fixed distance from each other. Spacer plates 224, 226 have pairs of apertures 228, 230, one at either end of each plate in alignment with apertures 220 in each roller. Bridges 232, 234 are each substantially V-shaped and comprise first and second legs 236, 238 intersecting at elbow 240. The ends of each leg form roller securing means 242, 244 for securing spacer plates 224, 226 to rollers 216, 218. Ropes 246, 247 are secured respectively to each of elbows 240. Handles 248, 249 are secured respectively to the free ends of ropes 246, 247. Handles 248, 249 are adapted to receive the free ends of rope 162, which may then be secured to handles 208 by any conventional means.

Preferably, the frame of roller means 164 is made of a heavy wire which, while substantially rigid, provides a small amount of resiliency.

Referring back to FIG. 1, removable gate means 115 preferably comprises vertical spaced apart members 256, 258 joined across their tops by gate crossbar 260. Gate means 115 is attached to front section 100*a* of frame 100 by connectors 262, 264 connected respectively to front vertical spaced apart members 128, 130. In a preferred embodiment, removable gate 115 may be horizontally offset from the plane formed by members 128, 130 by the provision of short pieces of tubing 266, 268 respectively connecting members 128, 130 to members 256, 258. When gate 115 is not in use, connectors 262, 264 may be used as hand grips for aiding the user in sitting down on or getting up from body support means 104.

A model constructed to verify the operation of the present invention consisted of a support frame built of strong and lightweight plastic tubing and plastic connectors. The support frame was approximately 24 inches wide and 24 inches deep. Crossbars 121, 127, and were placed approximately 5 inches from the bottom of vertical spaced apart members 116, 118, 122, 124 and 128, 130 respectively. Platform 102 was constructed from a piece of plywood approximately 24 inches wide and 24 inches deep, and was suspended on horizontal support members placed approximately 18 inches from the bottom of vertical spaced apart members 116, 118, 122, 124 and 128, 130. Rear vertical spaced apart members 116, 118 were each approximately 5 feet in height and intermediate vertical spaced apart members 122, 124 were each approximately 6 feet in height.

In operation, the user may sit at the front of the apparatus, between front vertical spaced apart members 128, 130 and exercise using pairs of resilient hand grip means 106, 108 or 110, 112. Resilient hand grip means 106, 108 are primarily for overhead use. Grasping handles 156, the user may engage in conventional stretching and strengthening exercises, or may roll forward and back or side-to-side, aided by the resiliency of body support means 104. Resilient hand grip means 110, 112 may be used conventionally by pulling handles 156 over the shoulders or to the sides, to strengthen the stomach, shoulder, neck and arm muscles. The apparatus of the invention is so configured that the user may devise other kinds of exercise using resilient hand grip means 106, 108 or 110, 112 in combination with resilient body support means 104. Gate 115 is removed during exercise in which resilient hand grip means 106, 108 or 110, 112 are employed.

Referring now to FIG. 2, massage means 114 may be used in the standing position by connecting roller means 164 with rope 162. The user places massage means 114 around his or her body, and by manipulation of rope 162 with his or her hands can move roller means 164 up, down and across any portion of the body where massage by the roller is desired. Pulleys 158, 160 in combination with rope 162 enable massage means 114 to be manipulated with one hand, thus suiting massage means 114 to use by a handicapped person having use of only one arm or hand. When massage means 114 is used in the standing position, gate 115 is removed.

Massage means 114 may also be used in the sitting position. Again, the user is seated on resilient body support means 104 at the front of the apparatus between front vertical spaced apart members 128, 130. After being seated, the user replaces gate 115. Rope 162 is connected to roller means 164. As when standing, massage means 114 is placed around the body of the user, roller means 164 being at the back. Rope 162 is passed around the front gate 115. The user may manipulate roller means 164 as before, by manipulating rope 162. Additional upward or downward motion of massage means 114 is provided by the sliding of rope 162 up and down vertical spaced apart members 256, 258 of gate 115. The lateral sliding motion of rope 162 against vertical spaced apart members 256, 258 also permits manipulation of rope 162 by a handicapped person.

In addition, roller means 164 may be detached from rope 162 and used independently of the apparatus of the invention by manipulating the roller across the body by pulling on the handles.

Obviously, numerous modifications and variations of the present invention are possible in light of the above teachings. It is therefore to be understood that within the scope of the appended claims, the invention may be practiced otherwise than as specifically described herein.

I claim as my invention:

1. Apparatus comprising:

platform means for supporting a person; massage means for engaging the body of a user, said massage means comprising an elongate flexible element and a massage element;

first arm means extending upwardly from a first end of said platform means for securing said massage means, whereby a person standing adjacent said platform means may grasp and pull alternately in a to-and-fro movement said elongate element to cause said massage element to massage a user's body; and removable gate means extending upwardly from a second end of said platform for slidably receiving said flexible element, whereby a person sitting upon said platform means and facing said gate means may, with the elongate flexible element passing over said gate means, grasp said elongate flexible element and alternately pull in a to-and-fro movement to cause massaging movement of said massage element on a user's body.

2. The apparatus as set forth in claim 1, wherein said massage means comprises:

said first arm means including first and second rear vertical spaced apart members;

first and second pulleys attached respectively to said first and second rear vertical spaced apart members, said elongate flexible element passing through said first and second, said roller means being pulleys, and said massage means including a roller means for massaging a user removably attached to the ends of said elongate flexible element.

3. The apparatus as set forth in claim 2, wherein said roller means comprises:

a cylindrical roller having an aperture therethrough;

substantially rigid frame means for rotatably supporting said roller comprising a leg passing through said aperture for rotatably securing said roller to said frame, an arcuate bridge connected to said leg and passing around the midsection of said roller, the ends of said bridge comprising first and second rope securing means;

first and second ropes secured at one end respectively to said first and second rope securing means, and first and second handles secured respectively to the other end of said first and second ropes.

4. The apparatus as set forth in claim 2, wherein said roller means comprises:

a cylindrical roller having an aperture therethrough, substantially rigid frame means for rotatably supporting said roller, said frame means being substantially Z-shaped and comprising upper and lower legs and a cross-piece diagonally connecting said legs at upper and lower elbows, the ends of said legs forming roller securing means for rotatably securing said roller to said frame means, first and second ropes secured at one end respectively to said upper and lower elbows, first and second handles secured respectively to said other end of said first and second ropes, and wherein said upper and lower legs are surrounded respectively by first and second guard tubes substantially along their entire length.

5. The apparatus as set forth in claim 2, wherein said roller means comprises:

a pair of parallel, spaced apart cylindrical rollers, each roller having an aperture therethrough, substantially rigid frame means for rotatably supporting said rollers comprising a pair of spacer plates positioned one at each pair of ends of said rollers and having a pair of apertures, one at either end of said plate in alignment with said apertures in said rollers, a pair of bridges, each bridge being substantially V-shaped and comprising first and second legs intersecting at an elbow, the ends of said leg forming roller securing means for securing said spacer plates to said rollers, first and second ropes secured at one end respectively to said elbows, and first and second handles secured respectively to said other end of said first and second ropes.

6. Apparatus as in claim 1 further comprising:

a second arm means extending upwardly from said platform means between said first arm means and said removable gate means for supporting a first pair of resilient hand grips.

7. Apparatus in claim 1 further comprising a second pair of resilient hand grips attached to said first arm means adjacent said platform means.

8. Apparatus as in claim 1 further comprising resilient body support means disposed on said platform means for supporting a person during a body massage operation.

9. The apparatus as set forth in claim 8, wherein said resilient body support means comprises first and second inflatable cushions, said first cushion comprising an inflatable ring having a center hole, and said second cushion comprising an inflatable sphere positioned in matching engagement with said center hole.

10. Compact, lightweight combination exercise and massage apparatus, which comprises:

a modular, tubular support frame having front, intermediate and rear sections, wherein said rear section of said support frame comprises first and second rear vertical spaced apart members joined across their tops by a rear top crossbar, and forming a first plane, said intermediate section of said support frame comprises first and second intermediate vertical spaced apart members joined across their tops by an intermediate top crossbar, and forming a second plane parallel to said first plane, said front section of said support frame comprises first and second front vertical spaced apart members forming a third plane parallel to said first and second planes, and wherein said rear vertical spaced apart members are joined to said intermediate vertical spaced apart members by a plurality of horizontal support members, and said intermediate vertical spaced apart members are joined to said front vertical spaced apart members by a plurality of horizontal support members;

a platform suspended horizontally on said support frame;

resilient body support means resting on said platform wherein the tops of said first and second front vertical spaced apart members are substantially level with the top of said resilient body support means;

first pair of resilient hand grip means slidably suspended from the intermediate section of said support frame;

second pair of resilient hand grip means suspended from the rear section of said support frame, wherein each of said first and second pairs of resilient hand grip means comprises a coil spring and a hand grip attached at one end thereof; and massage means suspended from the rear section of said support frame.

* * * * *